US007176876B2

(12) United States Patent
Kabuto et al.

(10) Patent No.: US 7,176,876 B2
(45) Date of Patent: Feb. 13, 2007

(54) DISPLAY APPARATUS

(75) Inventors: Nobuaki Kabuto, Kunitachi (JP); Toshimitsu Watanabe, Yokohama (JP); Yoshie Kodera, Chigasaki (JP); Mutsumi Suzuki, Kodaira (JP); Tetsu Ohishi, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 315 days.

(21) Appl. No.: 10/632,585

(22) Filed: Jul. 31, 2003

(65) Prior Publication Data

US 2004/0189553 A1 Sep. 30, 2004

(30) Foreign Application Priority Data

Mar. 24, 2003 (JP) ..... 2003-079349

(51) Int. Cl.
*G09G 3/36* (2006.01)

(52) U.S. Cl. ..... 345/100; 345/89; 345/204; 345/206; 345/210; 315/169.1; 315/169.3

(58) Field of Classification Search ..... 345/60, 345/63, 64, 67, 68, 205, 206, 207, 210, 89, 345/96, 99, 100, 204; 310/292, 310, 336; 315/169.1, 169.3
See application file for complete search history.

(56) References Cited

U.S. PATENT DOCUMENTS 4,481,511 A * 11/1984 Hanmura et al. ..... 345/100
5,479,188 A * 12/1995 Moriyama ..... 345/89
5,959,603 A 9/1999 Ito et al.
6,154,187 A * 11/2000 Kim ..... 345/60
6,259,198 B1 * 7/2001 Yanagisawa et al. ..... 313/495
6,472,803 B1 * 10/2002 Yoshizawa et al. ..... 313/310
2002/0018032 A1 * 2/2002 Weitbruch et al. ..... 345/60
2002/0036460 A1 * 3/2002 Takenaka et al. ..... 313/495
2002/0036602 A1 * 3/2002 Huang et al. ..... 345/60
2002/0130824 A1 * 9/2002 Huang et al. ..... 345/60
2003/0011551 A1 * 1/2003 Takahashi et al. ..... 345/87
2003/0016189 A1 * 1/2003 Abe et al. ..... 345/55

FOREIGN PATENT DOCUMENTS

EP 0458169 A2 11/1991

(Continued)

*Primary Examiner*—Bipin Shalwala
*Assistant Examiner*—Vincent E. Kovalick
(74) *Attorney, Agent, or Firm*—Townsend and Townsend and Crew LLP

(57) ABSTRACT

The present invention provides a bright and high-resolution display apparatus having a dynamic range exceeding the number of gray-scale voltage (or current) outputs, which a signal driver is capable of generating. In accordance with the present invention, a select period, in which a group of pixels on each row is driven, is divided into a plurality of sub-periods. The signal driver supplies a voltage output varying from sub-period to sub-period to selected pixels through a signal electrode. The pixel is capable of expressing various values of a gray scale, the size of which is at least approximately equal to (the number of gray-scale voltage outputs, which the signal driver is capable of generating)×(the number of sub-periods). By changing the ratio of the length of a sub-period to the length of another sub-period or the range of the driving voltage (or current), the dynamic range of the display can be further increased.

22 Claims, 13 Drawing Sheets

FOREIGN PATENT DOCUMENTS

| | | |
|---|---|---|
| JP | HEI 6-11688 | 1/1994 |
| JP | HEI 9-114414 | 5/1997 |
| JP | HEI 20-198312 | 7/1998 |
| JP | 2000-347163 | 12/2000 |
| JP | 2001-83907 | 3/2001 |
| JP | 2002-341365 | 11/2002 |
| JP | 2003-29727 | 1/2003 |

* cited by examiner

| OUTPUT ↓ | b8 | 0 | | 1 | |
|---|---|---|---|---|---|
| | Tb/Ta | Ta PERIOD | Tb PERIOD | Ta PERIOD | Tb PERIOD |
| bo0 | | b0 | 0 | 1 | b0 |
| bo1 | | b1 | 0 | 1 | b1 |
| bo2 | | b2 | 0 | 1 | b2 |
| bo3 | | b3 | 0 | 1 | b3 |
| bo4 | | b4 | 0 | 1 | b4 |
| bo5 | | b5 | 0 | 1 | b5 |
| bo6 | | b6 | 0 | 1 | b6 |
| bo7 | | b7 | 0 | 1 | b7 |

DISPLAY APPARATUS

BACKGROUND OF THE INVENTION

The present invention relates to a flat display apparatus such as an FED (Field Emission Display) unit using display elements comprising typically electron emission devices laid out to form a matrix and pieces of fluorescent material each emitting light due to electrons emitted by the electron emission devices.

As the electron emission devices, a MIM (Metal-Insulator-Metal) type electron source is used. The MIM electron source has a structure comprising three thin film layers, which serve as an upper electrode, an insulator and a lower electrode respectively. The display apparatus adopts an FED driving technique connecting the upper electrode to a column electrode (or a signal electrode) and the lower electrode to a row electrode (or a scanning electrode). A typical FED driving technique is disclosed in Japanese Patent Laid-open No. 2001-83907. In accordance with this reference, a scanning electrode is associated with a group of pixel rows and the pixel group is driven sequentially one row after another.

A second prior art is disclosed in Japanese Patent Laid-open No. 2002-341365. In accordance with this reference, a scanning electrode driven sequentially is associated with a group of pixels on pair rows to form a double-matrix electron pattern used in a liquid crystal driving circuit. The second-prior art can be applied also to the FED unit.

SUMMARY OF THE INVENTION

In accordance with the first prior art described above, the pixels are driven sequentially one row after another. Thus, in the case of a high-resolution panel, a select period of a row is short. As a result, this technique is prone to a lack of a driving timing margin. In addition, since a light emission period is also short, there is raised a problem of a difficulty to obtain a high intensity of light.

In addition, in accordance with the first prior art, by properly changing the magnitude of a voltage applied to the signal electrode to a level adjusted to a picture signal, a picture with various gray-scale levels can be generated. The voltage applied to the signal voltage is a voltage for driving the electron emission devices. Thus, in order to produce a TV picture having a high quality, it is desirable to set the number of bits for digital image data at a value in the range of 8 to 12. The number of bits is the base of the driving voltage cited above. That is to say, the number of bits is the input-bit count of a D/A (Digital to Analog) converter for converting the digital image data into an analog driving voltage. In general, however, the input-bit count of a D/A converter serving as a driver for applying the driving voltage to the signal electrode is a value in the range of 6 to 8. Thus, if an ordinary D/A converter is employed, the size of the gray scale is a value in the range of 64 to 256. For this reason, it is desirable to further improve the gray-scale performance of the FED unit. The gray-scale performance is referred to as a dynamic range.

Let the second conventional technology be applied to, for example, the FED unit described as a part of the first prior art. In this case, pixels on two rows are driven at the same time. Thus, the select period of a pixel group comprising two rows is twice the corresponding period according to the first prior art. As a result, a driving timing margin can be assured with ease. In addition, since the light emission period is also increased, there is offered an advantage that it is easy to produce a high light intensity. Like the first prior art described above, however, also in the case of the second technique, the dynamic range of the light emission is limited by the input-bit count of the D/A converter serving as the signal driver. Thus, it is impossible to display a picture with a gray-scale size greater than the gray-scale size, which is determined by the input-bit count of the D/A converter.

It is an object of the present invention to address the problems described above to display a bright picture with a high resolution by improving the gray-scale performance. To put it concretely, it is an object of the present invention to improve the gray-scale performance by providing a capability of displaying a picture with a gray-scale size greater than the gray-scale size determined by the input-bit count of the D/A converter, which serves as the signal driver.

In addition, it is a second object of the present invention to improve the brightness of picture with good gray-scale performance.

In order to achieve the first object described above, the present invention is characterized in that, during a select period to select at least one row of a plurality of display devices (electron emission devices), which are laid out to form a matrix, at least two driving voltages with levels different from each other are applied to the selected display devices. The select period is a period during which a select voltage is being applied to the scanning electrode. To put it in detail, in accordance with the present invention, the select period is divided into a plurality of sub-periods and, during each of the sub-periods, a driving voltage with a level different from levels of the driving voltages applied during the other sub-periods is applied to the selected electron emission devices.

In accordance with the configuration of the present invention, a pixel corresponding to a driven electron emission device is capable of realizing a display with the number of gray-scale levels at least equal to about (the number of gray-scale voltage levels that can be output by the signal driver)×(the number of sub-periods in the select period). Assume for example that the 8-bit D/A converter serving as the signal driver has an input-bit count of 8. In this case, the number of gray-scale voltage levels that can be output by the signal driver is 256. Thus, if the select period is divided into two sub-periods, a pixel has an ability to display 512 (=2×256) gray-scale levels. That is to say, in accordance with the present invention, it is possible to realize a multiple gray-scale display with many gray-scale levels exceeding the maximum gray-scale levels, which is determined by the input-bit count of the D/A converter serving as the signal driver.

In addition, in order to achieve the second object of the present invention, besides the present invention's characterization described above, the present invention is further characterized in that a plurality of rows of electron emission devices is driven at the same time. For example, as a plurality of rows to be driven at the same time, two adjacent rows may be selected. In this case, one of the two rows selected at the same time may be selected again during another select period. In this way, the length of a select period for each row, that is, a select period for pixels on the row, can be increased. Thus, the intensity of light can be increased with ease and the signal driver can be relieved from a requirement of a high operation speed due to the division of the select period.

DETAILED DESCRIPTION OF PREFERRED EMBODIMENTS

Figure 1:
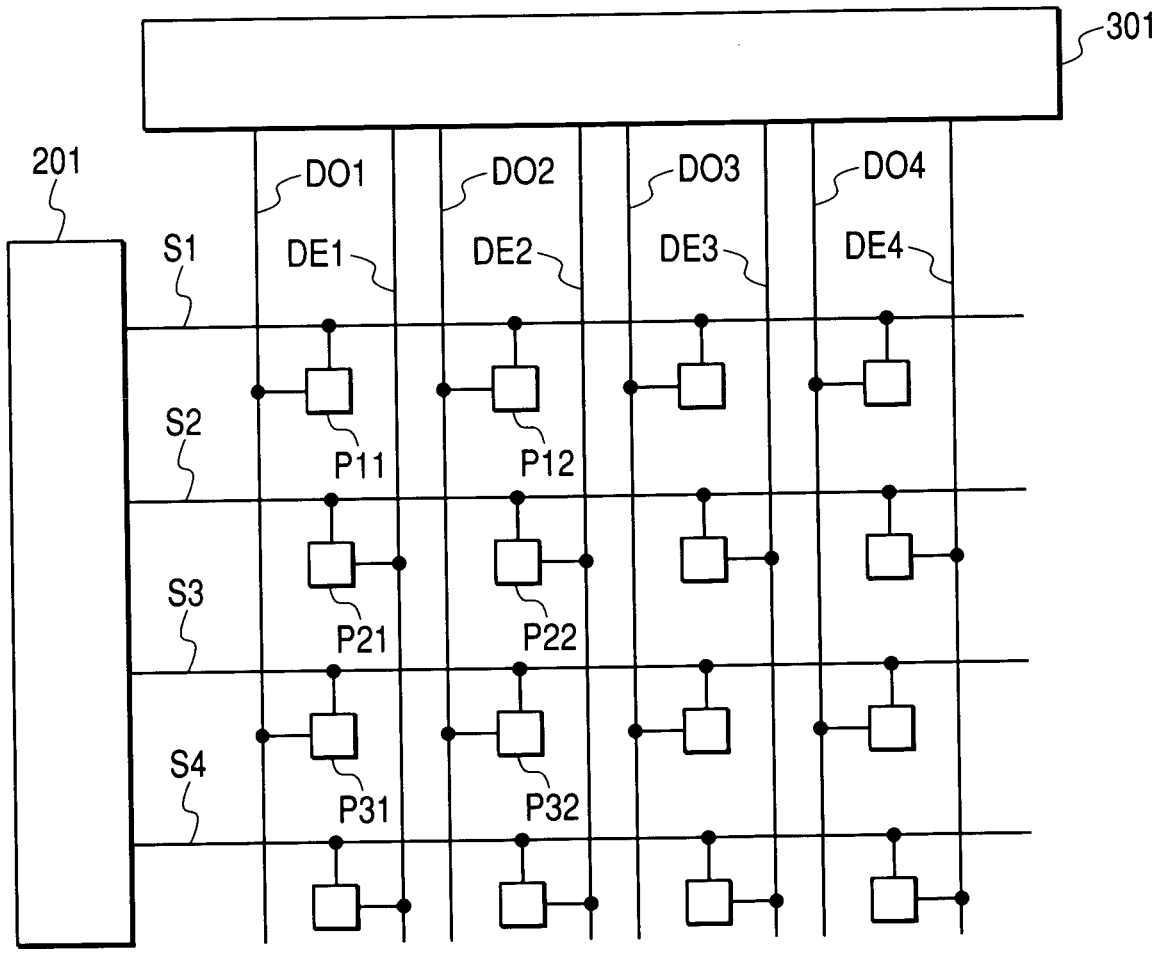
FIG. 1 is a block diagram showing a first embodiment of a pixel layout and electrode wiring of a display apparatus provided by the present invention.

Embodiments of the present invention will be explained in detail with reference to the diagrams. FIG. 1 is a block diagram showing a first embodiment of a pixel layout and electrode wiring of a display apparatus provided by the present invention. The display apparatus implemented by the embodiment comprises a plurality of pixels P11, P12 and so on, a plurality of scanning electrodes S1, S2 and so on, a plurality of signal electrodes DO1, DE1, DO2, DE2 and so on, a scanning driver 201 and a signal driver 301. The pixels P11, P12 and so on are laid out to form a matrix. The scanning electrodes S1, S2 and so on are each extended in the horizontal direction of the screen, each forming a row of the matrix. The signal electrodes DO1, DE1, DO2, DE2 and so on are each extended in the vertical direction of the screen, each forming a column of the matrix. The scanning driver 201 is a driver for applying a select voltage to a desired row in order to select the row. The signal driver 301 is a driver for applying a driving voltage to a signal electrode in order to drive pixels on the signal electrode. The pixels Pij are each located at an intersecting point of one of the scanning electrodes Si and one of the signal electrodes DOj/DEj. In addition, the pixel Pij is connected to the scanning electrode Si and the signal electrode DOj/DEj. Thus, a select voltage and a driving voltage are supplied to the pixel Pij by the scanning electrode Si and the signal electrode DOj/DEj respectively. FIG. 1 shows the pixel layout's enlarged partial model comprising (4×4) pixels in a matrix consisting of 1,920 columns of pixels and 1,080 rows of pixels. It is needless to say that the pixel matrix is not limited to the matrix consisting of 1,920 columns of pixels and 1,080 rows of pixels.

A pixel on any specific one of the odd-numbered scanning electrodes S1, S3 and so on is connected to one of the odd-numbered signal electrodes DO1, DO2 and so on that crosses the specific odd-numbered scanning electrode Si. Likewise, a pixel on any specific one of the even-numbered scanning electrodes S2, S4 and so on is connected to one of the even-numbered signal electrodes DE1, DE2 and so on that crosses the specific even-numbered scanning electrode Si. By taking the FED unit employing MIM electron emission devices as described in patent reference 1 as an example, the operation of the display apparatus comprising the pixels P11, P12 and so on as the MIM electron emission devices as shown in FIG. 1 is explained by referring to waveforms shown in FIG. 2. In the following description, an MIM electron emission device is referred to simply as an MIM.

The FED unit comprises a rear substrate and a front substrate, which are placed in such a manner that the rear substrate and the front substrate face each other. The pixels P11, P12 and so on each serving as an electron emission device, the scanning electrodes S1, S2 and so on, the signal electrodes DO1, DE1, DO2, DE2 and so on, the scanning driver 201 and the signal driver 301 are created on the rear substrate to form the pattern and the connection wiring, which are shown in FIG. 1. On the other hand, pieces of fluorescent material are each created on the front-surface substrate at a location corresponding to one of the electron emission devices forming the matrix on the rear substrate. The pieces of fluorescent material each comprise an R fluorescent material emitting red light, a G fluorescent material emitting green light and a B fluorescent material emitting blue light.

A MIM has an upper electrode, a lower electrode and an insulation film between the electrodes. When a strong electric field is built up in the insulation film due to a driving voltage applied between the upper electrode and the lower electrode, electrons are injected from the lower electrode to the upper electrodes by way of a conduction band in the insulation film, becoming hot electrons. Some of the hot electrons having much energy surmount the upper electrode, being emitted to a vacuum. The emitted electrons are accelerated by applying a high voltage of the order of 3 to 6 kV to an acceleration electrode, which is located at a position in close proximity to the pieces of fluorescent material on the front substrate. The emitted electrons then hit the pieces of fluorescent material each provided at a location corresponding to one of the electron emission devices. The incident electrons excite each piece of fluorescent material, causing the fluorescent material to emit light with a color according to the emission characteristic. The lower electrode is connected to one of the scanning electrodes S1, S2 and so on, which apply a select voltage generated by the scanning driver 201. On the other hand, the upper electrode is connected to one of the signal electrodes DO, DE1 and so on, which apply a driving voltage generated by the signal driver 301.

Figure 2:
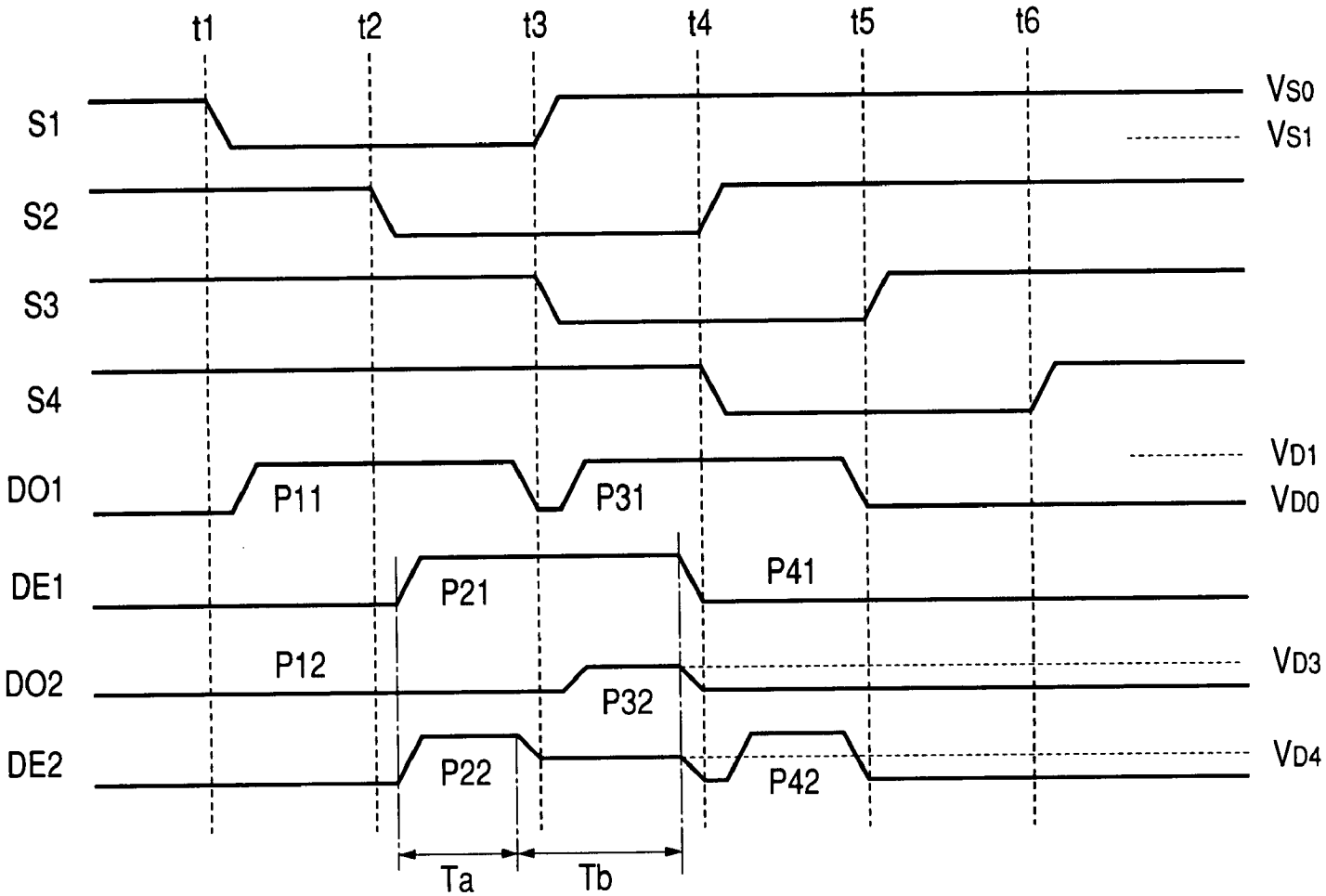
FIG. 2 is a diagram showing the waveforms of driving signals in the display apparatus provided by the present invention.

The operation of the block diagram shown in FIG. 1 is explained in more detail by referring to FIG. 2. In the period t1 to t3, the scanning driver 201 applies a select electric potential $V_{s1}$ to the scanning electrode S1 connected to the lower electrode of the MIM of the pixel P11. At the same time, the signal driver 301 applies an electric potential $V_{D1}$ to the signal electrode DO1 connected to the upper electrode. In this state, a voltage ($V_{D1}-V_{s1}$) is applied to the insulation film of the MIM. The MIM of the pixel P11 emits electrons, the number of which is proportional to the voltage. The electrons are then radiated to a fluorescent material corresponding to the pixel P11, causing the fluorescent material to emit light. The pixel P12 is also connected to the same scanning electrode S1 but connected to the signal electrode DO2, which receives an electric potential $V_{DO}$ from the signal driver 301 during the period t1 to t3. Thus, a voltage ($V_{DO}-V_{s1}$) is applied to the insulation film in the MIM of the pixel P12. If the electric potential $V_{DO}$ is set at such a value that the voltage does not exceed a threshold value of the MIM, the MIM does not operate so that a fluorescent material corresponding to the pixel P12 does not emit light. The threshold value is the lower limit of the applied voltage required for operating the MIM.

In a period after the time t3, a deselect electric potential $V_{s0}$ is applied to the scanning electrode S1 so that the applied voltage does not exceed the threshold value without regard to which of the electric potentials $V_{DO}$ and $V_{D1}$ is applied to the signal electrode DO1. As a result, no fluorescent material corresponding to an MIM on the deselected row is emitting light because the MIM is not operating in spite of the fact that the driving electric potential $V_{D1}$ is applied to the MIM.

As described above, among the MIMs laid out to form a matrix, only MIMs pertaining to a selected row are each selected as an operating MIM, which is a MIM put in a state of being capable of operating. The selected row is a row, to which the scanning driver 201 applies the select electric potential $V_{s1}$. To put it concretely, the selected row is either the scanning electrode S1 or the scanning electrode S2 or both. If a driving electric potential is further applied to a selected MIM, the MIM will emit electrons, the number of which is dependent on the driving electric potential.

Likewise, the select electric potential $V_{s1}$ is applied to the scanning electrode S2 serving as the second row during the period t2 to t4, which is a select period lagging behind the select period of the scanning electrode S1 serving as the first row by half the select period. The period t2 to t3 becomes a period in which the scanning electrodes S1 and S2 are selected at the same time. However, the pixels pertaining to the scanning electrode S1 are connected to the odd-numbered signal electrodes DO1, DO2 and so on whereas the pixels pertaining to the scanning electrode S2 are connected to the even-numbered signal electrodes DE1, DE2 so that a display by the pixels pertaining to the scanning electrode S1 and a display by the pixels pertaining to the scanning electrode S2 can be obtained independently of each other. Thereafter, subsequent select operations are carried out sequentially with each select operation delayed from the immediately preceding select operation by half the select period. As a result, any arbitrary picture display can be obtained by independently emitting light during every select period of each of the rows.

Next, the configuration of the gray scale according to the present invention is explained. As the signal driver 301, typically, a driver including an embedded so-called 8-bit D/A conversion function is used. Such a driver is capable of outputting a voltage for 256 gray-scale levels. It is thus obvious that a display with 256 gray-scale levels can be obtained. In accordance with the present invention, each MIM's select period determined by the output period of a select voltage generated by the scanning driver 201 is divided into two sub-periods, namely, a first sub-period and a second sub-period. The output period is the duration of the select electric potential $V_{s1}$. During each of the first sub-period and the second sub-period, any one of 256 gray-scale driving voltages independent from each other can be applied. Thus, the size of the gray scale that can be displayed is substantially twice the number of voltage outputs generated by the signal driver 301. As a result, a display with a gray-scale size of 511 can be realized.

If at least first and second driving voltages having levels independent from each other are applied to MIMs of a certain row during the select period of the row, that is, if first and second driving voltages with the levels thereof adjustable independently of each other are applied to the MIMs, what is visible to the human eyes is a result of addition of emitted light represented by the first driving voltage and emitted light represented by the second driving voltage. Thus, even if the gray scale levels represented by each of the first and second driving voltages is k, that is, even if the quantity of the emitted light is 0, 1, 2, - - - , or (k−1), a picture can be expressed in terms of (2k−1) gray scale levels, that is, the picture can be displayed as a result of emission with light quantities of 0, 1, 2, - - - , (k−1), k, (k+1), - - - and (2k−2). In this way, by dividing the select period into sub-periods and applying driving voltages with independent levels to each of the sub-periods, the gray scale levels can be increased to approximately the product of the number of such driving voltages and the number of sub-periods. It is to be noted that the figure shows a case in which the pixels P32 and P42 emit electrons only during the first sub-period Ta of each of their select periods.

In addition, the lengths of the first sub-period Ta and the second sub-period Tb do not have to be equal to each other. Instead, the ratio of the length of the first sub-period Ta to the length of the second sub-period Tb is changed so that the dynamic range of the light emission can be further improved without increasing the number of sub-periods. In this case, the dynamic range of the light emission is defined as a ratio of a minimum intensity to a maximum intensity where the minimum intensity means a lowest gray-scale level emitted light next to no emitted light. For example, if the ratio of the length of the first-half sub-period Ta to the length of the second-half sub-period Tb is 1:2, the dynamic range can be tripled. In this case, an intensity difference per gray-scale granularity close to the maximum intensity increases to a value twice that in a low-intensity portion. Since the display intensity is high, however, there is no problem.

Figure 3:
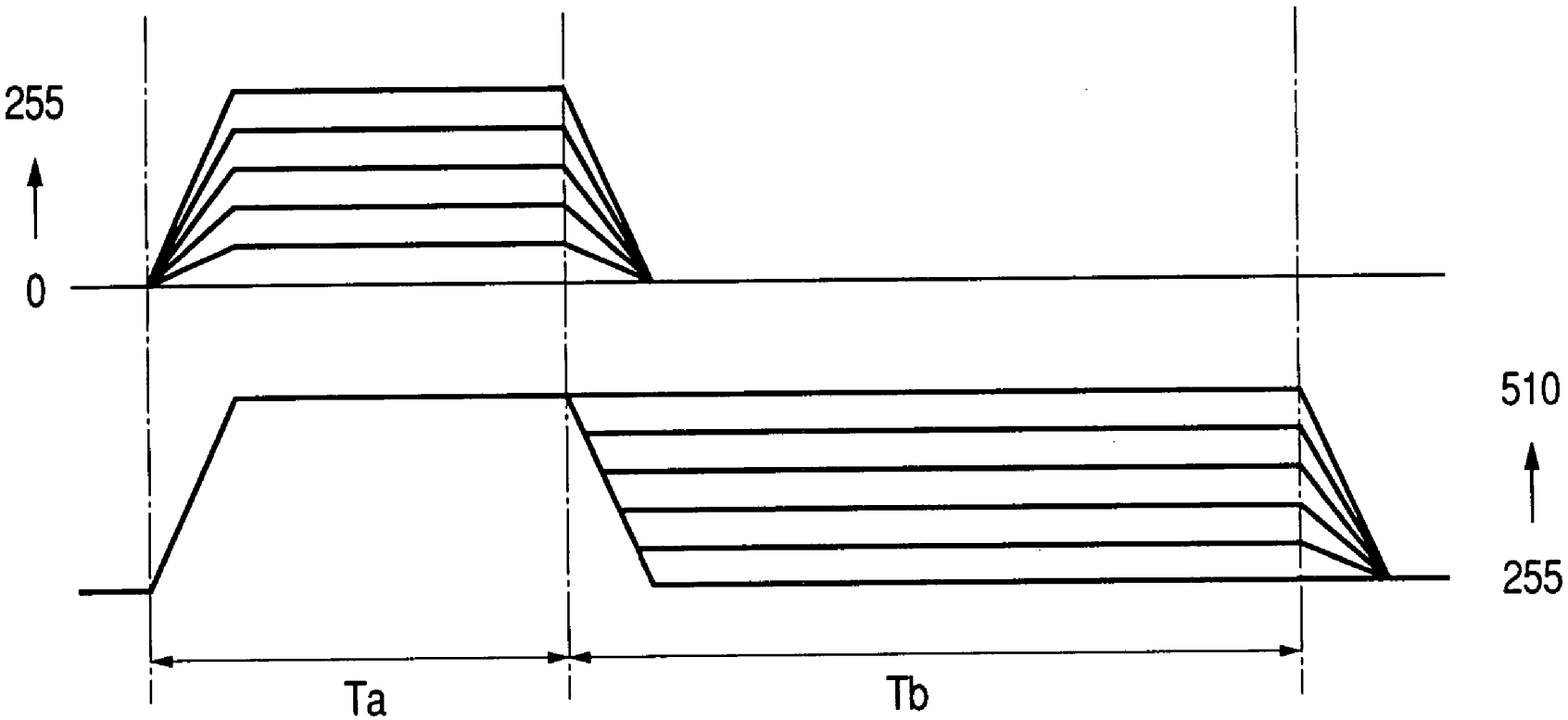
FIG. 3 is a diagram showing the waveform of a driving signal generated by a signal driver to generate a typical gray scale display in accordance with the present invention.

FIG. 3 is a diagram showing the waveform of a driving signal generated by the signal driver 301 and typical allocation of gray-scale granularities. During a long second sub-period Tb, the voltage level is set at 0. During a short first sub-period Ta, on the other hand, voltage levels of 0 to 255 are output to generate emitted light of 255 gray-scale levels. Pieces of emitted light of the gray-scale range 255 to 510 are always generated at a voltage level of 255 in the first-half sub-period Ta and at voltage levels of 0 to 255 in the second-half sub-period Tb to provide emitted light of the gray-scale range 255 to 510.

In a low-intensity portion or a dark picture area, the driving voltage applied in the longer sub-period (or the second-half sub-period Ta) is set at 0 and the driving voltage applied in the shorter sub-period (or the first-half sub-period Tb) is varied so that a difference in intensity between adjacent gray-scale values can be made small. Thus, a fine gray-scale display can be obtained. In a high-intensity portion or a bright picture area, the driving voltage applied in the shorter sub-period (or the first sub-period Tb) is set at a maximum value and the driving voltage applied in the longer sub-period (or the second sub-period Ta) is varied so that a difference in intensity between adjacent gray-scale values cane be made large. Since the intensities themselves are high, however, the rate of changes in intensity is relatively small so that there is almost no problem in the sense of sight. That is to say, in accordance with the present invention, either the first sub-period Ta or the second sub-period Tb is selected in dependence on the intensity of the picture for use in control of the gray scale. In addition, there is also offered an advantage that the monotonous rising characteristic of the level of the emitted light is sustained in spite of the fact that the difference in intensity per step changes from a value on one side of a boundary to another value on the other side of a boundary, which is the value of the 255th gray scale level. The change in intensity difference per step can be corrected by means of a gray-scale correction circuit using an LUT (Look Up Table). An example of the gray-scale correction circuit is the so-called gamma correction circuit.

The figure does not show the fact that, by widening the range of the driving voltage (or the driving current) applied during the second sub-period Tb to exceed the range of the driving voltage (or the driving current) applied during the first sub-period Ta, the difference in intensity per step can also be changed. In addition, by raising the high voltage applied to a fluorescent material in order to accelerate emitted electrons during the sub-period Tb, the same effects can also be exhibited even if the duration of the sub-period Ta is equal to the duration of the sub-period Tb and the range of the driving voltage (or the driving current) applied during the sub-period Tb is about the same as the range of the driving voltage (or the driving current) applied during the sub-period Ta.

It is to be noted that, even if the duration of the first sub-period Ta is set at a length equal to the duration of the second sub-period Tb, due to distortions of the waveform of the driving voltage and other causes, the brightness can be more than doubled by additionally emitting light during the second sub-period Tb continuously following the first sub-period Ta in comparison with a case in which light is emitted only during the first sub-period Ta. This difference in intensity per step can be corrected if the gray-scale correction circuit described above is employed.

By the way, in order to avoid cross-talks and to obtain a stable display gray scale, after the scanning electrode S2 transits to the select electric potential $V_{s1}$ to enter a select state at the time t2 in the driving voltages' waveforms shown in FIG. 2, the signal electrode DE1 transits to the electric potential $V_{D1}$, lagging behind the transition of scanning electrode S2 to the select electric potential $V_{s1}$. In addition, before the scanning electrode S2 starts a transition to the deselect electric potential $V_{s0}$ at the time t3, the signal electrode DE1 completes a transition to the electric potential $V_{DO}$. That is to say, by setting the rising edge of the driving voltage generated by the signal driver 301 at a time lagging behind each of the timings t1, t2 and so on of the starts of the select voltages output by the scanning driver 201 and by setting the falling edge of the driving voltage generated by the signal driver 301 at a time leading ahead of each of the timings t3, t4 and so on of the starts of the select voltages, it is possible to offer an advantage that, as a driving system, extra timings no longer need to be set. In this case, the second half of the select period of a row becomes the long second sub-period Tb and the duration of the first sub-period Ta can be set at a value obtained by subtracting a period from duration of the second sub-period Tb. The period subtracted from the duration of the second sub-period Tb corresponds to a delay of the waveform of the select voltage generated by the scanning driver 201 and the distortions of the waveform.

In this embodiment, the light-emission period is divided into two sub-periods, namely, the first sub-period Ta and the second sub-period Tb. However, it is needless to say that, by dividing the light-emission period into three or more sub-periods as described earlier, the dynamic range of the display can be further increased.

Figure 4:
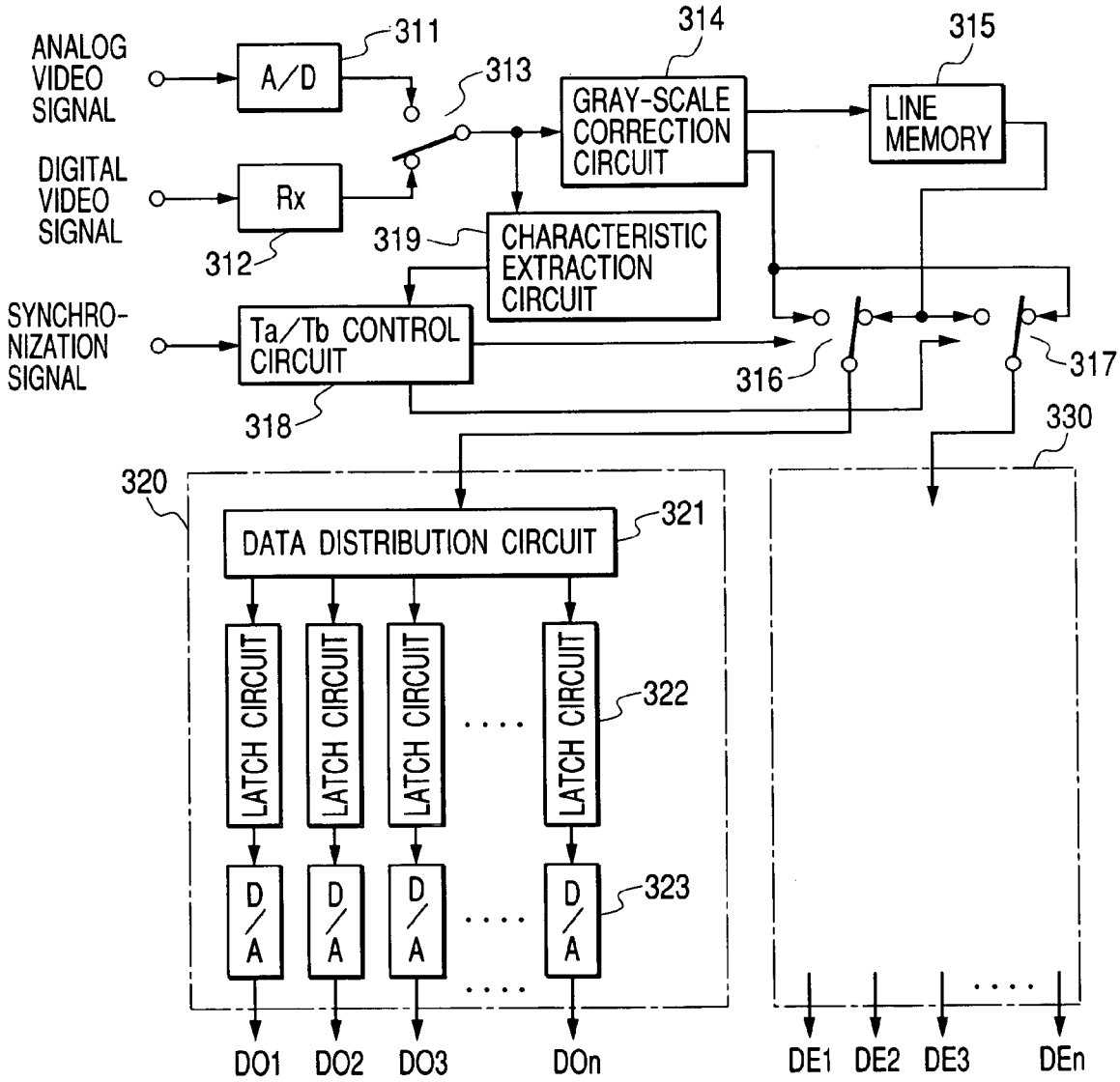
FIG. 4 is a block diagram showing an embodiment implementing the display apparatus provided by the present invention.

FIG. 4 is a block diagram showing an embodiment implementing the display apparatus provided by the present invention. Examples of the display apparatus are the monitor provided for a personal computer and a TV receiver. To put it more concretely, the block diagram shows the signal driver 301 shown in FIG. 1 and a typical signal-processing system for-generating a signal applied to the signal driver 301. The signal driver 301 shown in FIG. 1 includes a signal driver 320 for driving a group of odd-numbered signal electrodes DO1, DO2 and so on as well as a signal driver 330 for driving a group of even-numbered signal electrodes DE1, DE2 and so on. The signal drivers 320 and 330 have the same configuration including a data distribution circuit 321 for distributing an input signal to columns of the matrix, latch circuits 322 each used for latching a distributed signal and D/A conversion circuits 323 each used for converting a digital signal stored in one of the latch circuits 322, which is associated with the D/A conversion circuit 323, into a predetermined analog voltage. The operation of the signal-processing system is explained as follows.

The display apparatus is capable of inputting or receiving both an analog video signal and a digital video signal. An input analog video signal is converted into a digital signal by an A/D (Analog to Digital) converter 311. On the other hand, an input digital video signal is decoded by using a reception interface (RX) 312, which includes a digital decoder. Signals output by the A/D converter 311 and the reception interface 312 are supplied to a switch 313. The switch 313 selects one of the signals and supplies the selected signal to a gray-scale correction circuit 314, which functions as a driving signal generator. The signal selected by the switch 313 is a digital video signal. Typically including an LUT (Look Up Table), the gray-scale correction circuit 314 carries out a gray-scale correction process such as a gamma correction process to determine the display apparatus' gray-scale value corresponding to the digital video signal.

The gray-scale correction circuit 314 has a function for transforming the bit count of the digital video signal received from the switch 313 into two driving signals. If the D/A conversion circuit 323 embedded in the signal drivers 320 and 330 has an input bit count of 8, for example, the gray-scale correction circuit 314 provided by this embodiment transforms the bit count of the digital video signal into 16-bit signals. That is to say, the gray-scale correction circuit 314 has a function to transform the bit count of the digital video signal input thereto into output signals each having a bit count greater than the bit count of the digital video signal. The 16-bit signal obtained as a result of the transformation is divided into a first 8-bit driving signal and a second 8-bit driving signal. The first 8-bit driving signal serves as the base of a driving voltage applied to the signal electrode in the first sub-period Ta. On the other hand, the second 8-bit driving signal serves as the base of a driving voltage applied to the signal electrode in the second sub-period Ta. In the case of a gray-scale value lower than an intermediate boundary gray-scale value of 255, the first driving signal has a value representing the input video signal while all the bits of the second driving signal are set to 0. In the case of a gray-scale level higher than the intermediate boundary gray-scale value of 255, on the other hand, the second driving signal has a value representing the input video signal while all the bits of the first driving signal are set to 1 to represent a value of 255.

By carrying out the operation of the gray-scale correction circuit 314 as described above, it is possible to generate the first and second driving signals to be applied to the first and second sub-periods Ta and Tb respectively as explained above by referring to FIG. 3. The first driving signal for the first sub-period Ta is output from a lower-side terminal of the gray-scale correction circuit 314, being supplied to a left-side terminal of a switch 316 and a right-side terminal of a switch 317. The switches 316 and 317 each function as a changeover switch. On the other hand, the second driving signal for the second sub-period Tb is output from an upper-side terminal of the gray-scale correction circuit 314, being supplied to a line memory 315. The line memory 315 delays the second driving signal by a period of time equal to the first sub-period Ta before supplying the second driving signal to a right-side terminal of the switch 316 and a left-side terminal of the switch 317.

The video signal selected by the switch 313 is also supplied to a characteristic extraction circuit 319 for extracting the video signal's characteristics such as a white peak level, an average intensity level and a brightness-classified histogram and supplying results of extraction to a Tb/Ta control circuit 318. The Tb/Ta control circuit 318 carries out an optimum picture-drawing operation by controlling parameters such as a ratio of the length of the sub-period Ta to the length the sub-period Tb on the basis of the extraction results received from the characteristic extraction circuit 319. In order to display an image dominated by a dark picture, for example, control is executed to shorten the first sub-period Ta. In order to display an image dominated by a bright picture, on the other hand, control is executed to lengthen the first sub-period Ta and adjust the lengths of both the first sub-period Ta and the second sub-period Tb so as to make the first-half sub-period Ta substantially equal in duration to the second sub-period Tb. As described above, not only can the apportionment of time among the first sub-period Ta and the second sub-period Tb be adjusted, but it is also possible to control other parameters such as the range of the driving voltage (or the driving signal) generated by the signal driver 301 in the first sub-period Ta and/or the second sub-period Tb and the high voltage applied to the fluorescent materials. By changing the variation range of the level of the driving signal generated by the gray-scale correction circuit 314 or changing the correction characteristic of the gray-scale correction circuit 314 in conformity with these adjustment and control, a more desirable picture-drawing operation can be carried out. It is to be noted that the ratio of the length of the sub-period Ta to the length the sub-period Tb can be switched from one value to another on a frame boundary or a line boundary.

In addition, the figures do not show the fact that, when the user sets the brightness and the contrast by using a remote controller, not only can the video signal level be corrected, but it is also possible to control other parameters such as the range of the driving voltage (or the driving signal) generated by the signal driver 301 in the first-half sub-period Ta and/or the second-half sub-period Tb and the high voltage applied to the fluorescent materials so as to allow a better picture-drawing operation to be carried out.

On the basis of synchronization signals such as the horizontal and vertical synchronization signals, the Tb/Ta control circuit 318 sets for example two horizontal scanning periods as a select period and further generates control signals showing the select period's first sub-period Ta and second sub-period Tb. There are two types of control signal. The control signal of the first type is provided for odd-numbered rows and the control signal of the second type is provided for even-numbered rows. A control signal provided for an even-numbered row has a waveform lagging behind the waveform of a control signal provided for an odd-numbered row by about a horizontal scanning period. These control signals control the switches 316 and 317 so that, for example, in the period t1 to t2, the second driving signal for the first row is supplied to the signal driver 320 after being delayed by about the first sub-period Ta and the second driving signal for the second row is supplied to the signal driver 330 without being delayed. These driving signals are each split into signals to be supplied to their respective columns by the data distribution circuit 321. Subsequently, in the period t2 to t3, the split signals are temporarily stored in their respective latches 322 before being converted by the D/A conversion circuits 323 into analog driving voltages which are then applied to their respective signal electrodes DO1, DO2 and so on.

In the period t2 to t3, the switches 316 and 317 each select a signal opposite to that shown in the figure. The first driving signal for the third row is supplied to the signal driver 320 without being delayed and the second driving signal for the second row is supplied to the signal driver 330 after being delayed by about the first sub-period Ta. These driving signals are each split into signals to be supplied to their respective columns by the data distribution circuit 321. Subsequently, in the period t3 to t4 the split signals are temporarily stored in their respective latches 322 before being converted by the D/A conversion circuits-323 into analog driving voltages which are then applied to their respective signal electrodes DO1, DO2 and so on. Thereafter, these select operations are repeatedly carried out in the same way.

If the signal electrodes on the odd-numbered rows shown in FIG. 1 are pulled up and connected to the signal driver 320 and the signal electrodes on the even-numbered rows shown in the same figure are pulled down and connected to the signal driver 330, the conventional signal driver adopting a simple matrix technique is used as it is. Thus, the embodiment shown in FIG. 1 has an advantage that the present invention can be implemented in the conventional signal driver.

Figure 5:
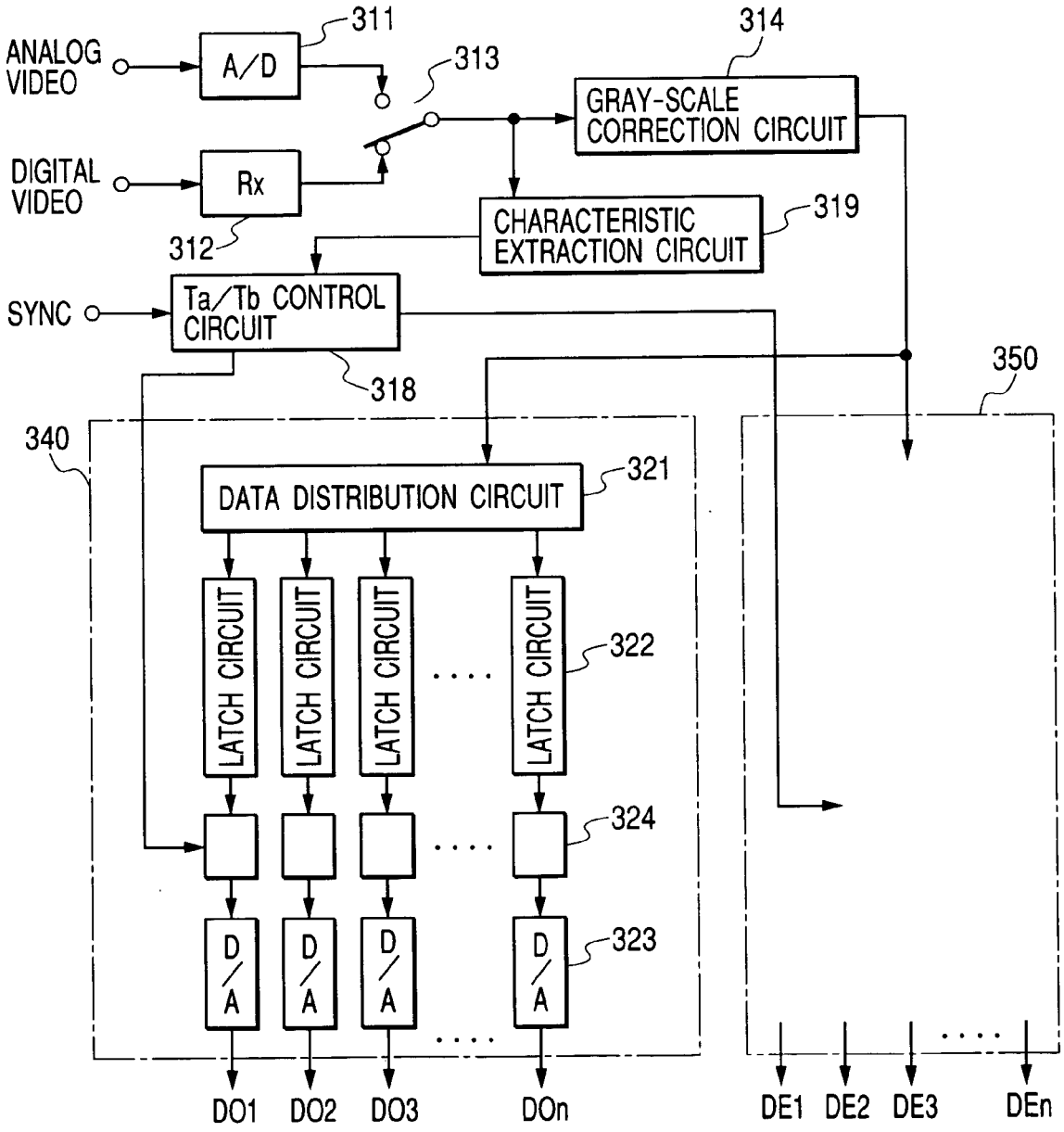
FIG. 5 is a block diagram showing another embodiment implementing the display apparatus provided by the present invention.

FIG. 5 is a block diagram showing a second embodiment implementing the display apparatus provided by the present invention. To put it more concretely, the block diagram shows the signal driver 301 shown in FIG. 1 and a typical signal-processing system for generating a signal applied to the signal driver 301. In the display apparatus shown in FIG. 5, the signal driver 301 shown in FIG. 1 comprises a group of odd-numbered signal electrodes DO1, DO2 and so on, a group of even-numbered signal electrodes DE1, DE2 and so on, a signal driver 340 for driving the odd-numbered signal electrodes DO1, DO2 and so on and a signal driver 350 for driving the odd-numbered signal electrodes DE1, DE2 and so on. The signal drivers 340 and 350 have the same configuration, which is identical with those of the signal drivers 320 and 330 shown in FIG. 4 except that a Ta/Tb signal converter 324 functioning as a changeover device is inserted immediately before each of the D/A conversion circuits 323.

Like the gray-scale correction circuit 314 shown in FIG. 4, a gray-scale correction circuit 314, which functions as a driving signal generator, has a function for transforming the bit count of a digital video signal into a signal with a bit count equal to the input bit count of the signal drivers 340 and 350. However, the input bit count obtained as a result of the transformation is different from that of the embodiment shown in FIG. 4. In the case of the embodiment shown in FIG. 5, a digital video signal with a bit count of 8 is transformed into a signal with a bit count of 9. This signal is used as a driving signal common to the sub-periods Ta and Tb in order to generate typically gray-scale values in the range of 0 to 511 corresponding to the 9 bits. It is the Ta/Tb signal converter 324 that generates a signal for the Ta/Tb periods.

Figures 6, 7:
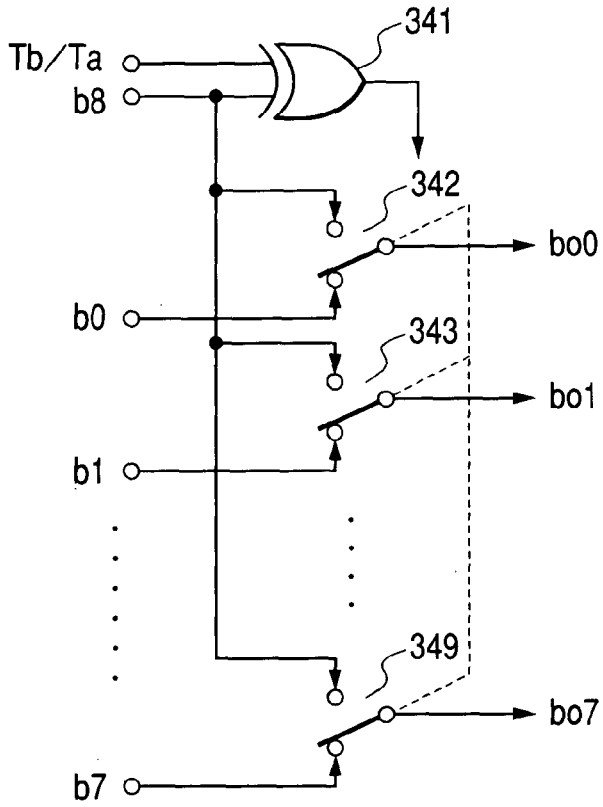
FIG. 6 is a block diagram showing an embodiment implementing a Ta/Tb signal converter employed in the display apparatus shown in FIG. 5.
FIG. 7 shows a truth table showing typical operations of the Ta/Tb signal converter employed in the other embodiment shown in FIG. 5.

FIG. 6 is a block diagram showing an embodiment implementing the Ta/Tb signal converter 324 and FIG. 7 shows a truth table showing typical operations of the Ta/Tb signal converter 324. If the driving signal represents a gray-scale value of n where n is a number in the range of 0 to 255, that is, if the most significant bit b8 of the driving signal is 0, bits b0 to b7 are output as they are during the sub-period Ta and "0" is output in the sub-period Tb. If the driving signal represents a gray-scale value of n where n is a number in the range of 256 to 511, that is, if the most significant bit b8 of the driving signal is 1, on the other hand, bits b0 to b7 are output as they are during the sub-period Tb and "1" is output in the sub-period Ta. That is to say, in this embodiment, the most significant bit of the 9-bit driving signal obtained as a result of the transformation carried out by the gray-scale correction circuit 314 is detected and its value is used as a criterion for determining first and second driving signals to be apportioned to the first sub-period Ta and the second sub-period Tb. In this case, however, the driving signal representing a gray-scale value of 255 causes the signal driver to output the same waveform as the driving signal representing a gray-scale value of 256. For this reason, considering the fact that the corrected output for a gray-scale value of 255 results in the same gray-scale level as the corrected output for the gray-scale value of 256, the gray-scale correction circuit 314 adopts a technique such as a method of setting the LUT data so as not to use the corrected output for the gray-scale value of 255 or 256.

In FIG. 5, the signal driver 340 is a driver in charge of driving a group of odd-numbered signal electrodes connected to pixels connected to a group of odd-numbered scanning electrodes. On the other hand the signal driver 350 is a driver in charge of driving a group of even-numbered signal electrodes connected to pixels connected to a group of even-numbered scanning electrodes. For this reason, the Tb/Ta control circuit 318 outputs control signals for controlling the drivers 340 and 350 with the control signals'waveforms shifted from each other by half the select period of one row. In the embodiment described earlier, the length of half the select period of one row is equal to the length of one horizontal period of the video signal.

In the system shown in FIG. 5, it is necessary to add a dedicated horizontal driver including the Ta/Tb signal conversion circuit to that shown in FIG. 4. However, the logic circuit of the Ta/Tb signal conversion circuit can be realized relatively with ease. In addition, since the line memory 315 is not required, the scale of the circuit can be suppressed to a relatively small one. Thus, the system shown in FIG. 5 has merits such as a cost advantage over that shown in FIG. 4.

Figure 8:
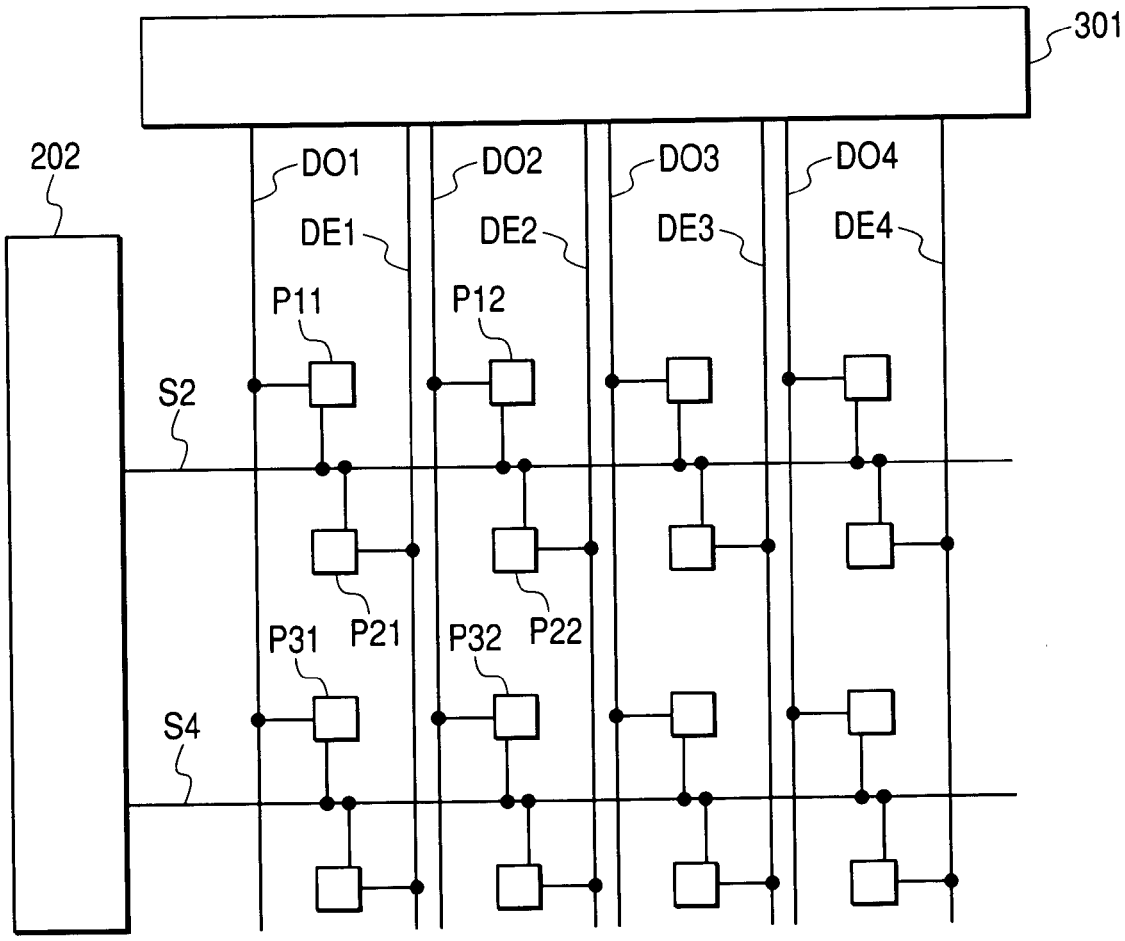
FIG. 8 is a block diagram showing a second embodiment of a pixel layout and electrode wiring of the display apparatus provided by the present invention.
Figure 9:
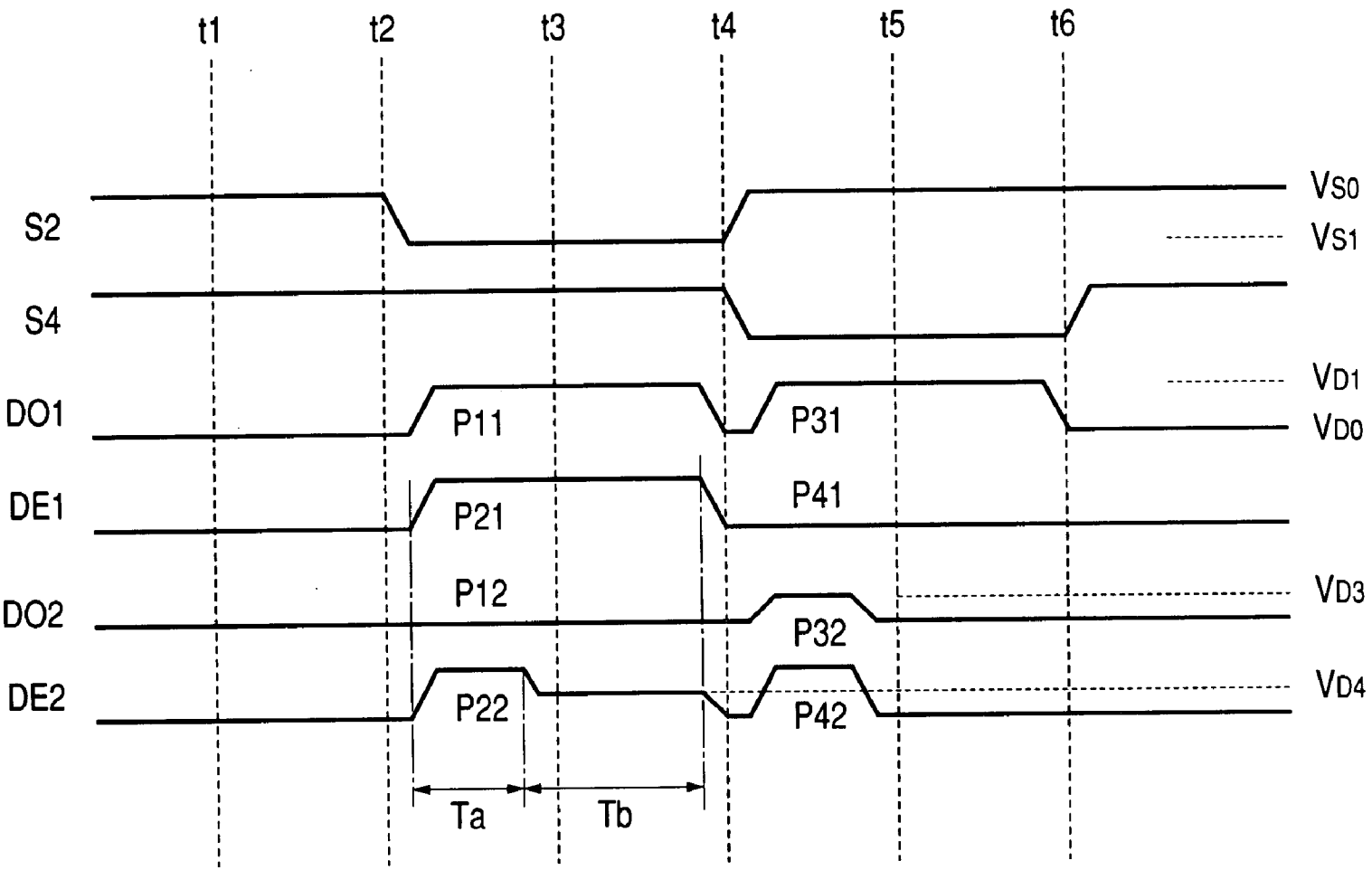
FIG. 9 is a diagram showing the waveforms of driving signals for the second embodiment shown in FIG. 8.

FIG. 8 is a block diagram showing a second embodiment of a pixel layout and electrode wiring of the display apparatus provided by the present invention and FIG. 9 is a diagram showing the waveforms of electrode select and driving signals generated by electrodes in the second embodiment. In the embodiment shown in FIG. 1, scanning electrodes are laid out, each forming a row. In the case of the embodiment shown in FIG. 8, on the other hand, two rows are driven at the same time by the same scanning electrode. Thus, the number of scanning electrodes can be reduced and the fabrication yield can hence be increased. The number of outputs on a scanning electrode driver 202 is only half the number of outputs on the scanning electrode driver 201. Comparison of the typical driving waveforms shown in FIG. 9 with the typical driving waveforms shown in FIG. 2 indicates that the waveforms of signals generated by the odd-numbered signal electrodes DO1 and DO2 connected to pixels on odd-numbered rows in this embodiment are each delayed by one horizontal scanning period. In order to generate a delay signal for such delaying, it is necessary to provide the signal-processing circuit with a circuit equivalent to the line memory.

Figure 10:
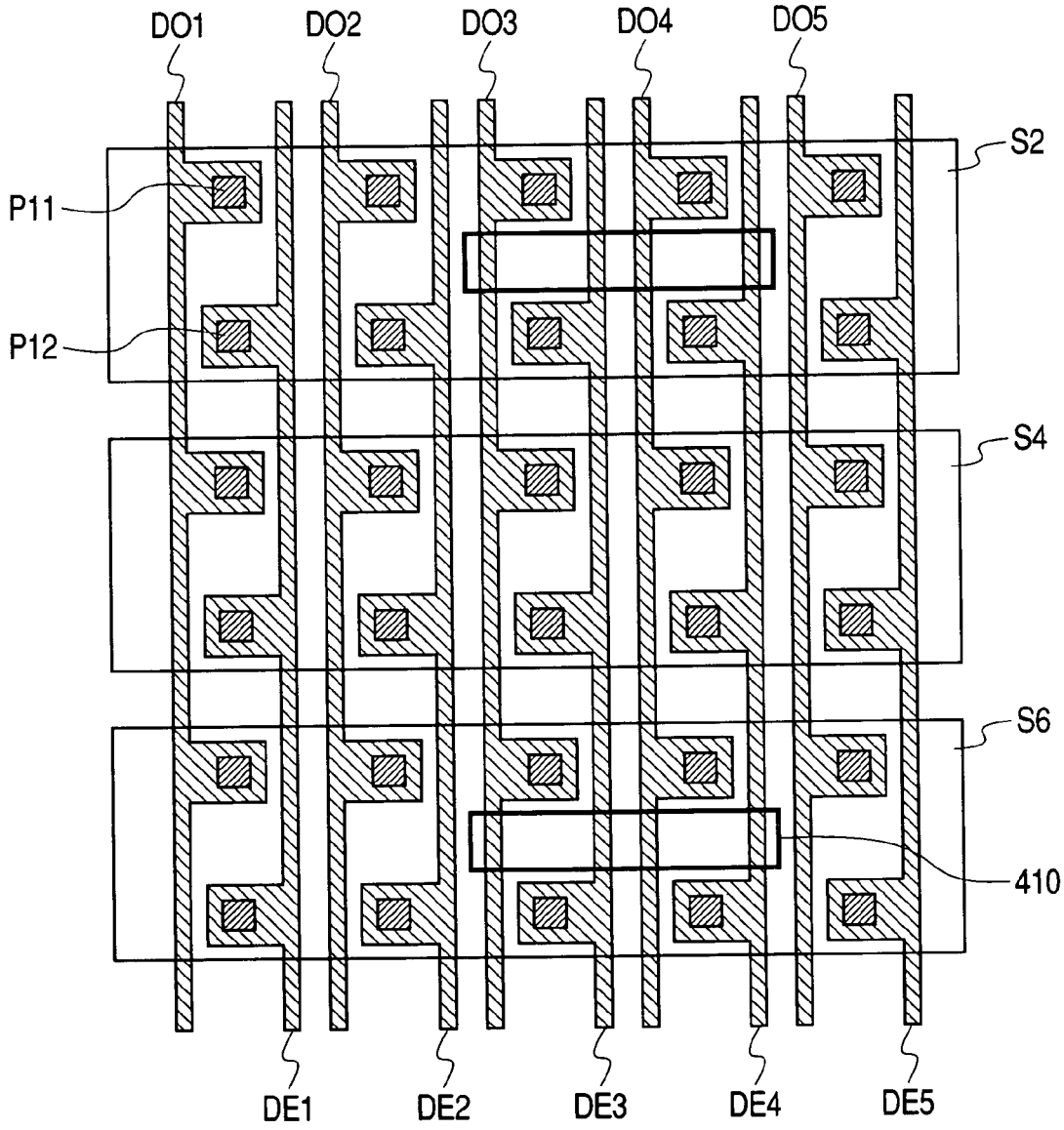
FIG. 10 is a diagram showing an electrode pattern for the second embodiment shown in FIG. 8.
Figure 11:
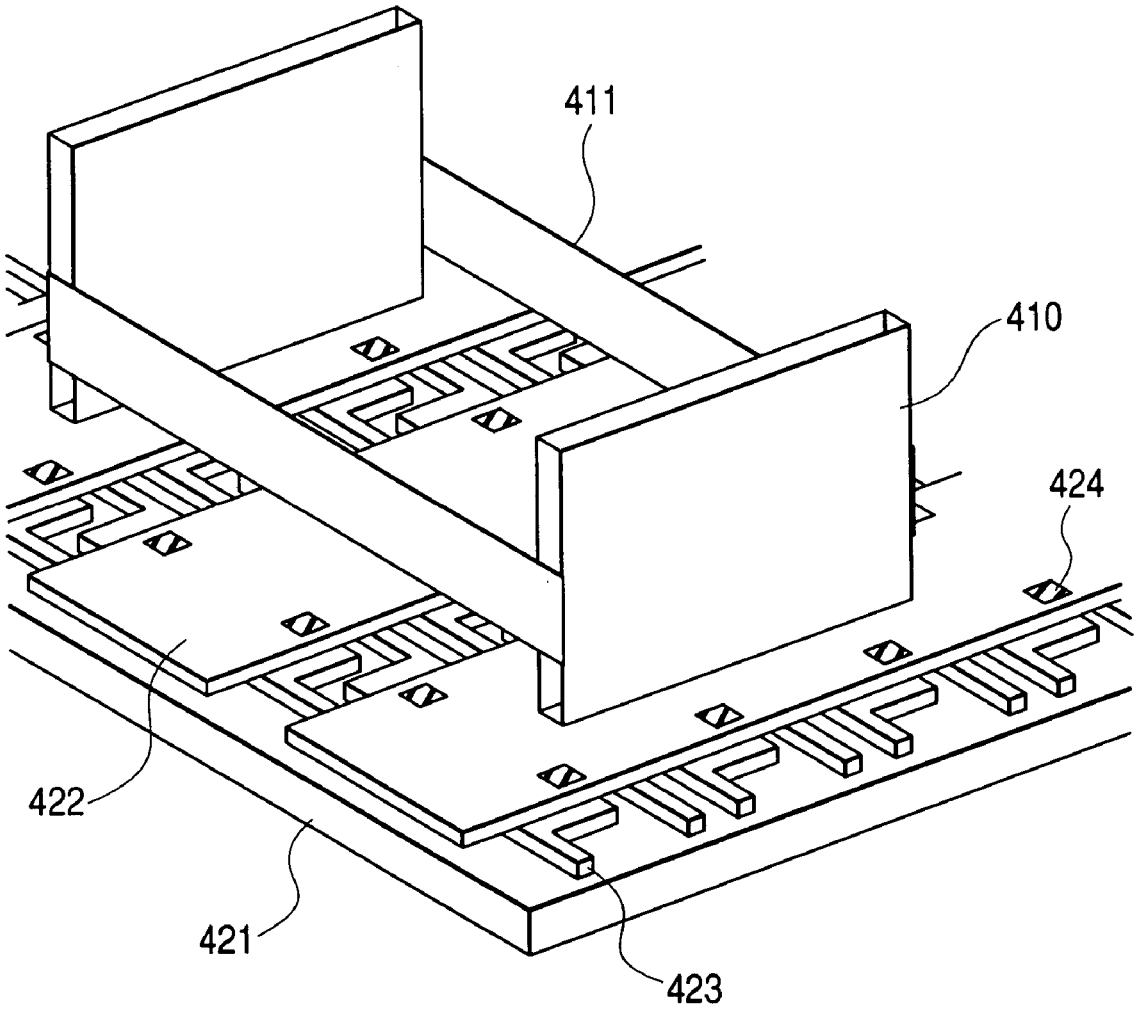
FIG. 11 is a diagram showing a perspective view of spacers and a rear substrate, which are applied to the present invention.

FIG. 10 is a diagram showing an electrode pattern for the second embodiment shown in FIG. 8 and FIG. 11 is a diagram showing a perspective view of a rear substrate including spacers. The rear substrate comprises a glass substrate 421, scanning electrodes 422, signal electrodes 423 and electron emission devices 424.

In order to build an FED unit, it is necessary to provide a front substrate facing the rear substrate. On the front substrate, which is not shown in FIG. 11, a fluorescent material and anodes are created. In order to realize an even and uniform picture display, spacers 410 each having a typical height of 2 mm may be created between the rear substrate and the front substrate so as to keep a uniform gap between the substrates. The spacers 410 are each placed at a location avoiding pixels so as not to obstruct paths of electrons emanating from the rear substrate. For a pixel gap of 0.3 mm, each of the spacers 410 is provided to have a thickness in a range of about 0.05 to 0.1 mm and a height of approximately 2 mm. In order to erect such thin and tall spacers 410 vertically, support bodies 411 for holding the spacers 410 are provided in advance. The support bodies 411 each have a thickness about equal to or smaller than the thickness of a spacer 410. It is convenient to assemble the spacers 410 and the support bodies 411 so as to create a box-like configuration.

However, some electrons may hit a spacer 410, causing electric charge to be accumulated on the spacer 410. In order to get rid of this electric charge, little conductivity is provided on the surface of every spacer 410 and the spacers 410 are each put on a scanning electrode 422. In accordance with the present invention, in order to allow two rows each comprising a group of pixels to be selected by a scanning electrode 422, the width of every scanning electrode 422 is made large in comparison with that shown in FIG. 1. Thus, a spacer 410 erected on a scanning electrode 422 is allowed to have a large thickness. For this reason, the strength of every spacer 410 can be assured. In addition, it is possible to have a margin of tolerance in the alignment precision between a scanning electrode 422 and a spacer 410 erected thereon.

In assembling the FED unit, a force is applied to the back-face and front substrates to bind the substrates together. As a result, the spacers 410 provided between the back-face and front substrates get slightly into their respective underlying scanning electrodes 422. For this reason, every scanning electrode 422 is created with a relatively large thickness so as to make the scanning electrode 422 capable of playing the role of a cushion. Thus, when the FED unit is assembled, in order to prevent the wiring pattern from being injured, the support bodies 411 are attached to the spacers 410, being floated above the bottoms of the spacers 410 at an altitude at least equal to the thickness of every scanning electrode 422. In addition, the upper side of each support body 411, that is the side facing the front substrate, is placed at a position lower than the tops of the spacers 410 in order to avoid effects of electric-charge accumulation. In general, the FED unit is capable of generating a full-color display by arranging red, green and blue pixels as stripes oriented in the screen vertical direction. In consequence, the gap between two adjacent pixels in the horizontal direction is apt to become small but the gap between two adjacent pixels in the vertical direction is apt to become large. Thus, an electron emitted from an electron emission device 424 is affected by electric charge accumulated in a spacer 410 or the like existing between pixels arranged in the horizontal direction. As a result, it is quite within the bounds of possibility that the electron does not properly arrive at the fluorescent material. For this reason, the thickness of every support member 411 placed between pixels arranged in the horizontal direction had better be made smaller than that of the spacer 410 in consideration of the fact that the gap between two adjacent pixels in the horizontal direction is small.

Figure 12:
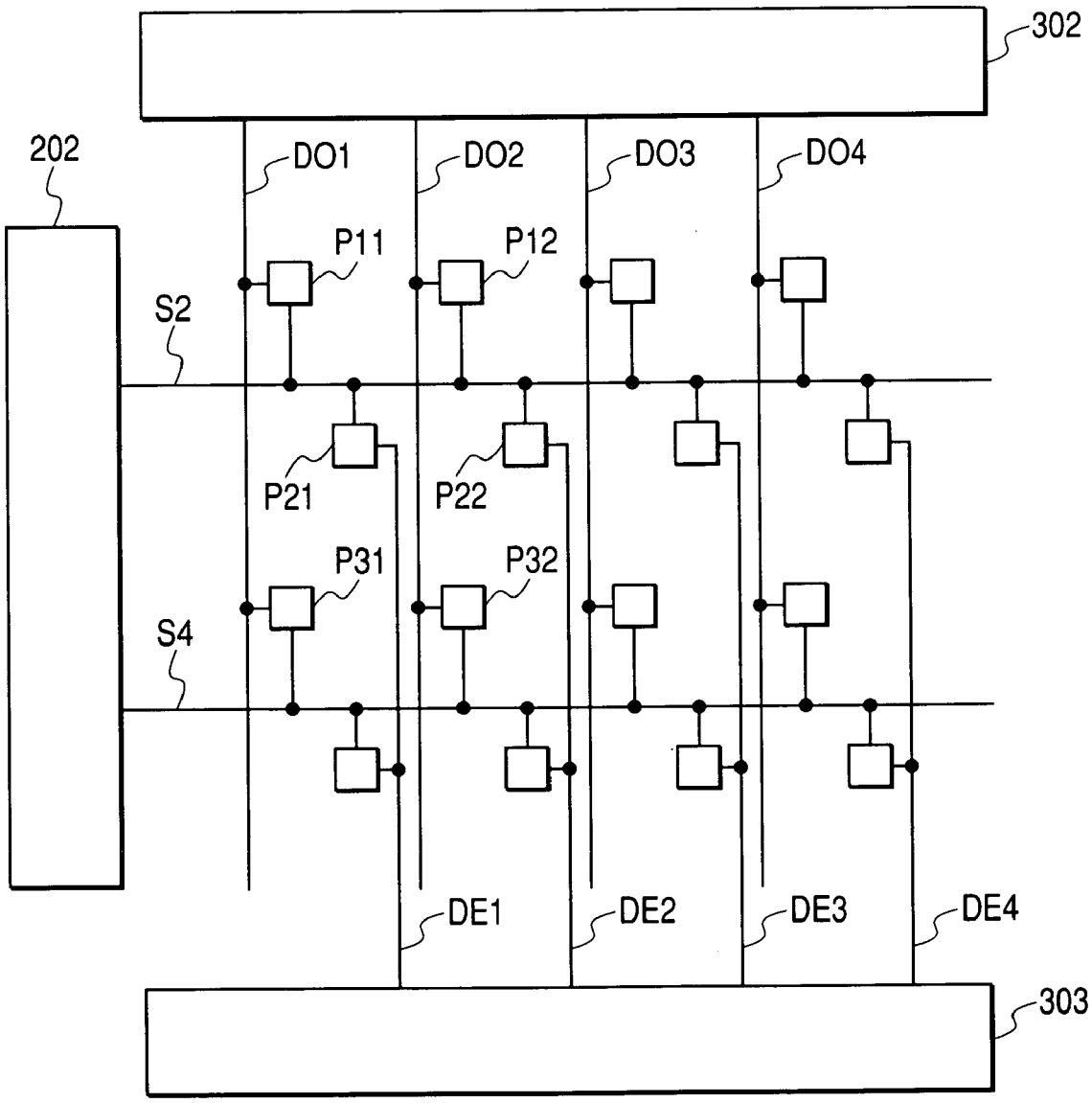
FIG. 12 is a block diagram showing a third embodiment of a pixel layout and electrode wiring of the display apparatus provided by the present invention.

FIG. 12 is a block diagram showing a third embodiment of a pixel layout and electrode wiring of the display apparatus provided by the present invention. The third embodiment is different from the embodiment shown in FIG. 8 in that, in the case of the third embodiment, the group of pixels on any even-numbered row is shifted in the right direction by half the gap between two adjacent pixels away from the group of pixels on any odd-numbered row. In addition, the signal electrode for every odd-numbered row is pulled up and connected to a signal driver 302 on the upper side while the signal electrode for every even-numbered row is pulled down and connected to a signal driver 303 on the lower side.

By shifting pixels on any even-numbered row away from pixels on any odd-numbered row, the number of pixels arranged in the horizontal direction appears larger, giving rise to an advantage of an improved resolution sense in the horizontal direction. In addition, by supplying signals to the signal electrodes from the upper and lower sides, it is possible to secure a large value of the connection pitch between the signal electrodes and the signal drivers.

Figure 13:
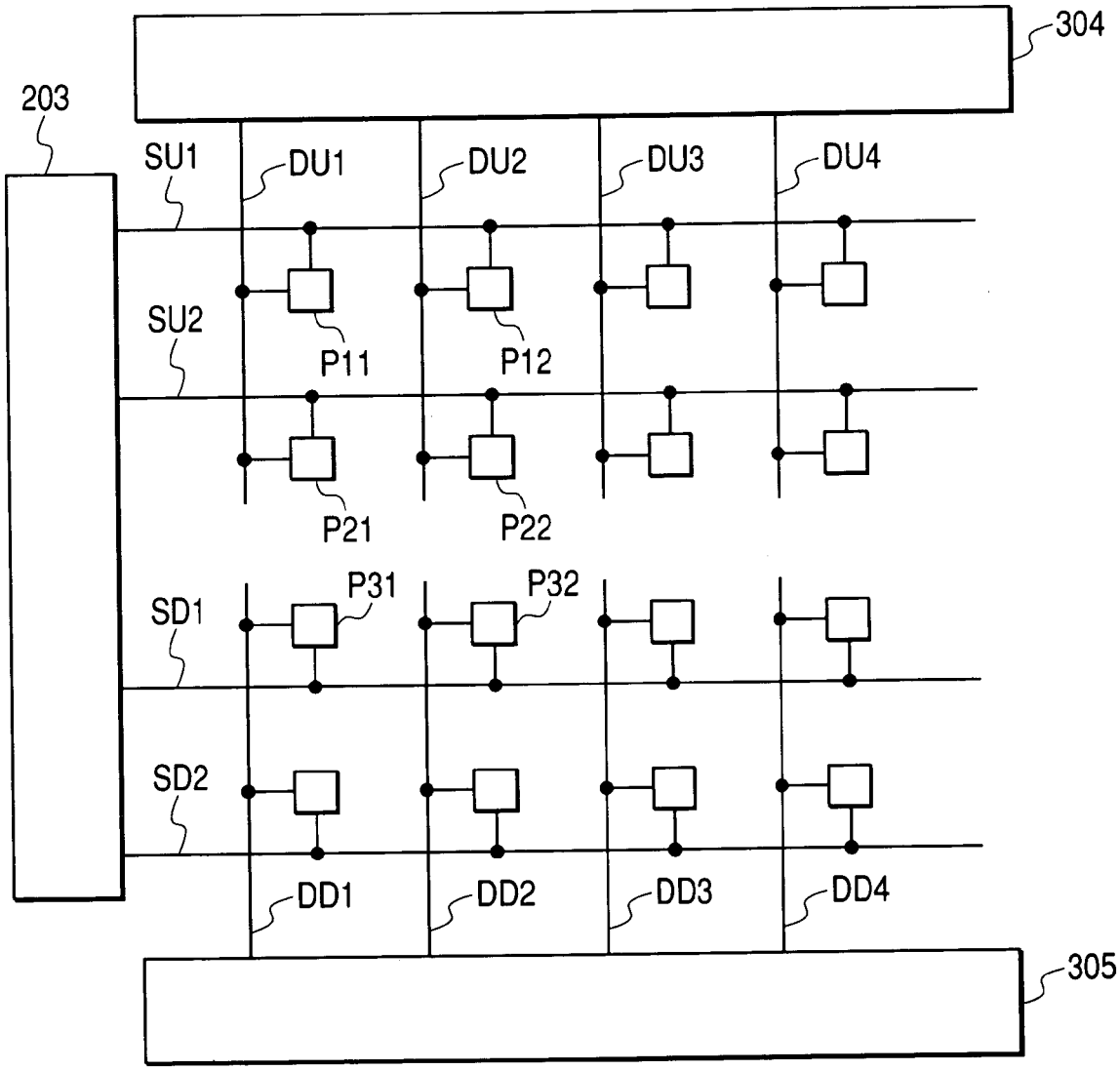
FIG. 13 is a block diagram showing a fourth embodiment of a pixel layout and electrode wiring of the display apparatus provided by the present invention.
Figure 14:
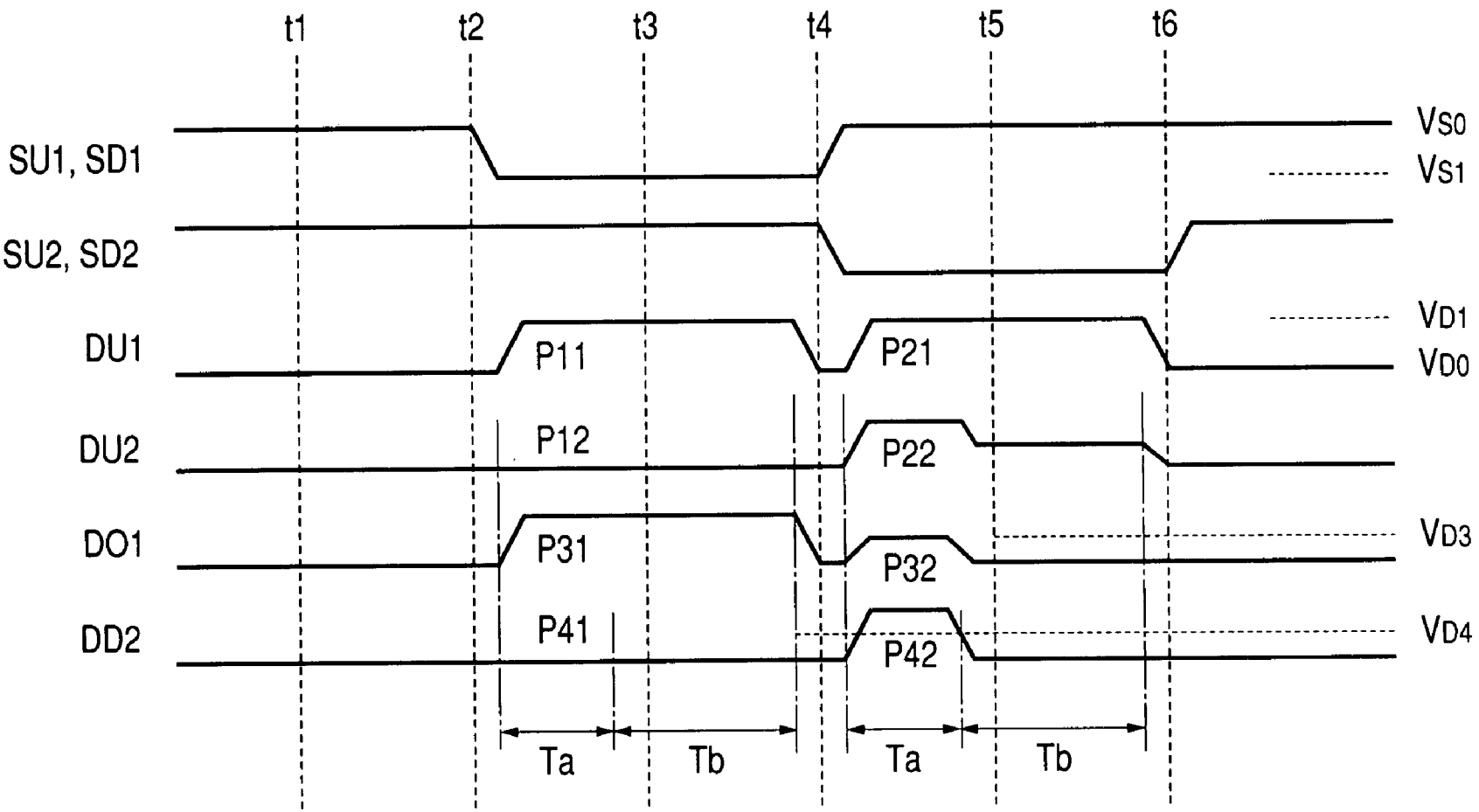
FIG. 14 is a diagram showing the waveforms of driving signals for the fourth embodiment shown in FIG. 13.

FIG. 13 is a block diagram showing a fourth embodiment of a pixel layout and electrode wiring of a display apparatus provided by the present invention and FIG. 14 is a diagram showing the waveforms of electrode select and driving signals for the fourth embodiment shown in FIG. 13. This embodiment implements a display apparatus having a configuration in which the screen is divided into an upper-side area and a lower-side area, which are each driven independently. The number of outputs from a scanning electrode driver 203 is equal to the number of pixels arranged in the vertical direction of the display apparatus. The scanning electrode SU1 is driven by a signal having the same waveform as a signal for driving the scanning electrode SD1. Likewise, the scanning electrode SU2 is driven by a signal having the same waveform as a signal for driving the scanning electrode SD2. Pixels P11, P12 and so on connected to the upper-side scanning electrodes SU1 and SU2 are connected to upper-side signal electrodes DU1, DU2 and so on, which are driven by an upper-side signal driver 304. Likewise, pixels P31, P32 and so on connected to the lower-side scanning electrodes SD1 and Sd2 are connected to lower-side signal electrodes DD1, DD2 and so on, which are driven by a lower-side signal driver 305. The embodiment shown in FIG. 13 can be regarded as an equivalent to the embodiment shown in FIG. 8 wherein the group of pixels on each odd-numbered electrode is allocated to the upper-side area whereas the group of pixels on each odd-numbered electrode is allocated to the lower-side area. Since the embodiment shown in FIG. 13 has the same operations as the embodiment shown in FIG. 8, detailed explanation is omitted.

In spite of the fact that the embodiment shown in FIG. 13 requires a frame memory for signal processing, this embodiment has an advantage that the number of signal electrode wires can be reduced to half the number of signal electrode wires in the embodiment shown in. FIG. 1. In the typical driving waveforms shown in FIG. 14, the timing to drive the bottom group of pixels in the upper-side area is shifted from the timing to drive the top group of pixels in the lower-side area. Thus, a shift in moving-picture display timing may result in, giving rise to a phenomenon in which, for example, a vertical line moving in the horizontal direction appears as a vertical line broken at its center. This problematic phenomenon can be eliminated by adjusting the timings, with which the bottom group of pixels in the upper-side area and the top group of pixels in the lower-side area are driven. That is to say, this problem can be solved by substantially reversing the scanning directions of the upper-side and lower-side areas.

In the present invention's embodiments described above, as typical electron emission devices of the FED unit, electron emission devices of the MIM type are employed. However, it is also possible to employ electron emission devices of a variety of other types such as a Spindt type, a surface conduction type and a carbon nano tube type. In the embodiments described above, an FED unit is used as the display apparatus, but the scope of this present invention is not limited to the FED unit. That is to say, the present invention can also be applied to a display apparatus employing an ELD (Electro-Luminescent Display) units, an OLED (Organic Light-Emitting Diodes) or other devices. To put it in detail, the present invention can also be applied to a display apparatus including electron injection devices for injecting electrons (or holes) to a light emission layer and the light emission layer for emitting light due to radiation of the electrons (or holes) injected by the electron injection devices to the light emission layer, wherein the number of electrons (or holes) injected by the electron injection devices can be controlled by adjusting a select voltage applied to a scanning electrode connected to the electron injection devices and a driving voltage connected to a signal electrode connected to the electron injection devices.

As described above, in accordance with the present invention, it is possible to improve the gray-scale performance and, hence, display a picture with a high intensity and a high resolution. Thus, in a flat display apparatus such as a FED unit, a picture having a high quality can be displayed.

What is claimed is:

1. A display apparatus comprising:

a front substrate on which a fluorescent material is provided;

a rear substrate disposed opposite to said front substrate and having a plurality of electron emission devices laid out thereon to form a matrix, each of said electron emission devices radiating electrons to said fluorescent material; and a driver capable of applying two or more driving voltages sequentially, which are generated on the basis of an input video signal and have levels independent from each other, during a select period to at least one row of specific electron emission devices selected among said electron emission devices, wherein said select period is divided into a plurality of sub-periods, wherein each of said driving voltages is applied in each of said sub-periods and at least one of said driving voltages has a gray-scale level corresponding to a level of said input video signal.

2. A display apparatus according to claim 1 wherein:

said input video signal is a digital video signal; and said two or more driving voltages are generated on the basis of a digital signal obtained as a result of converting the bit count of said digital video signal.

3. A display apparatus comprising:

a rear substrate including:

a plurality of scanning electrodes extending in a screen horizontal direction;

a plurality of signal electrodes extended in a screen vertical direction; and a plurality of electron emission devices placed at intersecting points of said scanning electrodes and said the signal electrodes, each of electron emission devices emitting electrons;

a front substrate disposed opposite to said rear substrate and provided with a fluorescent material emitting light due to electrons radiated thereto by said electron emission devices;

a scanning driver for applying to said scanning electrodes a select voltage for selecting at least one row of specific electron emission devices selected among said electron emission devices during a predetermined select period; and a signal driver for applying to said signal electrodes a driving voltage having a level depending on an input video signal for driving said electron emission devices, wherein:

the duration of said select period is determined by the output period of said select voltage;

said select period is divided into a plurality of sub-periods; and said driving voltage is applied in each of said sub-periods, wherein a picture can be displayed with a gray-scale corresponding to the number of said divided sub-periods and to a gray-scale size determined by said driving voltage.

4. A display apparatus according to claim 3 wherein the level of said driving voltage applied to said signal electrodes is changed for each of said sub-periods.

5. A display apparatus comprising:

a plurality of scanning electrodes extended in a screen horizontal direction;

a plurality of signal electrodes extended in a screen vertical direction;

a screen on which a plurality of display devices are placed at intersecting points of said scanning electrodes and said signal electrodes to form a matrix;

a scanning driver for applying to said scanning electrodes a select voltage for selecting at least one row of specific display devices selected among said display devices during a predetermined select period; and a driving signal generator capable of generating first and second driving signals, which have values independent from each other and each serve as a signal for driving said display devices, on the basis of an input video signal, wherein:

the duration of said select period of said row of specific display devices is determined by said select voltage generated by said scanning driver; and in said select period, driving voltages obtained on the basis of said first and second driving signals generated by said driving signal generator are applied consecutively to said signal electrodes, wherein said select period is divided into a plurality of sub-periods, wherein each of said driving voltages is applied in each of said sub-periods and at least one of said driving voltages has a gray-scale level corresponding to a level of said input video signal, wherein a picture can be displayed with a gray-scale corresponding to the number of said divided sub-periods and to a gray-scale size determined by said driving voltage.

6. A display apparatus according to claim 5 wherein:

said select period corresponds to at least two horizontal scanning periods.

7. A display apparatus comprising:

a plurality of scanning electrodes extended in a screen horizontal direction;

a plurality of signal electrodes extended in a screen vertical direction;

a screen on which a plurality of display devices are placed at intersecting points of said scanning electrodes and said signal electrodes to form a matrix;

a scanning driver for applying to said scanning electrodes a select voltage for selecting at least one row of specific display devices selected among said display devices during a predetermined select period;

a driving signal generator capable of generating first and second driving signals, which have values independent from each other and each serve as a signal for driving said display devices, by conversion of the bit count of an input digital video signal;

a switch for outputting said first driving signal generated by said driving signal generator during a first period for the select period determined by an output period of the select voltage generated by said scanning driver and outputting said second driving signal generated by said driving signal generator during a second period for the select period determined by an output period of the select voltage generated by said scanning driver; and a D/A converter for converting said first and second driving signals output by said switch into analog signals and for applying the analog signals to said signal electrodes as first and second driving voltages respectively.

8. A display apparatus according to claim 7 wherein:

said display device includes an electron injection device for injecting electrons and a light emission layer for emitting light due to electrons (or holes) radiated thereto from said electron injection device; and the number of electrons (or holes) radiated by said electron injection device is controlled by the select voltage applied to said scanning electrode connected to said display device and the driving voltage applied to said signal electrode connected to said display device.

9. A display apparatus according to claim 7 wherein the duration of said first sub-period is made different from the duration of said second sub-period.

10. A display apparatus according to claim 7 wherein:

the duration of said first sub-period is made shorter than the duration of said second sub-period;

in an operation to produce a dark gray-scale display, gray-scale control is executed so as to set said second driving voltage applied in said second sub-period at a fixed level of no light emission and vary said first driving voltage applied in said first sub-period; and in an operation to produce a bright gray-scale display, gray-scale control is executed so as to set said first driving voltage applied in said first sub-period at a fixed level of a substantially maximum light emission and vary said second driving voltage applied in said second sub-period.

11. A display apparatus according to claim 7, further comprising an extraction circuit for extracting characteristics of said input video signal, wherein the durations of said first and second sub-periods or ranges of said driving voltages applied in said sub-periods are changed in accordance with characteristic extraction results output by said extraction circuit.

12. A display apparatus according to claim 7, further comprising a brightness or contrast setting unit, wherein the durations of said first and second sub-periods or ranges of said driving voltages applied in said sub-periods are changed in accordance with a brightness or contrast set value.

13. A display apparatus according to claim 7 wherein said driving signal generator is a gray-scale correction circuit having a function to correct a gray-scale characteristic's discontinuity caused by a combination of said first and second driving voltages applied in said first and second sub-periods respectively.

14. A display apparatus according to claim 7 wherein said driving signal generator generates said first and second driving signals by converting said digital video signal into a signal having a bit count greater than the bit count of said digital video signal.

15. A display apparatus according to claim 7 wherein the sum of the bit counts of said first and second driving signals generated by said driving signal generator is greater than the bit count of said digital video signal.

16. A display apparatus according to claim 7 wherein the bit counts of said first and second driving signals generated by said driving signal generator are each equal to the bit count of a digital signal that can be handled by said D/A converter.

17. A display apparatus according to claim 7 wherein said scanning driver outputs a select voltage for selecting two rows of said display devices at one time in a sequential scanning operation carried forward in said screen vertical direction.

18. A display apparatus according to claim 7 wherein said scanning driver outputs a select voltage for selecting two rows of said display devices at one time in a sequential scanning operation carried forward in said screen vertical direction in such a way that a select period of one of said two selected rows does not completely coincide with a select period of the other selected row.

19. A display apparatus according to claim 7 wherein said scanning driver outputs a select voltage for selecting at least one row of said display devices located on the upper half side of said screen and at least one row of said display devices located on the lower half side of said screen.

20. A signal driver employed in a display apparatus, said apparatus having a plurality of scanning electrodes extended in a screen horizontal direction; a plurality of signal electrodes extended in a screen vertical direction; a plurality of display devices placed at intersecting points of said scanning electrodes and said the signal electrodes; and a screen comprising said display devices laid out thereon to form a matrix; wherein said signal driver used for applying a driving voltage for driving said display devices to said signal electrode, said signal driver comprising:

an n-bit gray-scale signal input terminal for inputting an n-bit gray-scale signal where $n \geqq 8$;

A sub-period select signal input terminal for inputting a sub-period specification signal for specifying one of m sub-periods obtained as a result of dividing a select period of said scanning electrodes where $m \geqq 2$;

an output circuit for outputting k voltage levels where $k \leqq$(the nth power of 2)/m; and a signal converter for selecting one of said k voltage (or current) levels on the basis of said n-bit gray-scale signal and said sub-period specification signal.

21. A display apparatus comprising:

a rear substrate including:

a plurality of scanning electrodes extended in a screen horizontal direction;

a plurality of signal electrodes extended in a screen vertical direction;

a plurality of electron emission devices placed at intersecting points of said scanning electrodes and said the signal electrodes, each of said electron emission devices emitting electrons;

a front substrate disposed opposite to said rear substrate and provided with a fluorescent material emitting light due to electrons radiated thereto by said electron emission devices; and spacers placed between said rear substrate and said front substrate to create a space between said rear substrate and said front substrate;

wherein:

each specific one of said scanning electrodes is connected to two rows each comprising a group of specific electron emission devices;

said two rows each comprising a group of specific electron emission devices are connected respectively to two different ones of said signal electrodes; and each of said spacers is located substantially at the center of said two rows each comprising a group of specific electron emission devices on said specific scanning electrode.

22. A display apparatus according to claim 21 wherein:

each two specific ones of said spacers are erected on different ones of said scanning electrodes to create a box-like configuration in conjunction with support members allowing said two specific spacers to support each other; and the upper sides of said support members are placed at positions lower than the tops of said specific spacers and the lower sides of said support members are floated above the bottoms of the spacers at an altitude at least equal to the thickness of each of said scanning electrodes.

* * * * *